United States Patent [19]

Hart et al.

[11] Patent Number: 4,907,524

[45] Date of Patent: Mar. 13, 1990

[54] METHOD AND DEVICE FOR CONTROLLING STRAIN AND/OR DEFLECTION IN SUPERSTRUCTURES

[75] Inventors: David W. Hart, Wilmington, Del.; Bohdan Dunas; Joseph Krulikowski, both of Philadelphia, Pa.

[73] Assignee: Special Projects Research Corporation, Wilmington, Del.

[21] Appl. No.: 228,716

[22] Filed: Aug. 5, 1988

[51] Int. Cl.[4] ..... B63B 15/00

[52] U.S. Cl. ..... 114/356; 114/65 R

[58] Field of Search ..... 114/270, 356, 74 A, 114/65 R, 71; 52/573, 731

[56] References Cited

U.S. PATENT DOCUMENTS

| | | | |
|---|---|---|---|
| 3,083,668 | 4/1963 | Marciano | 114/74 A |
| 3,422,779 | 1/1969 | Becker | 114/74 A |
| 3,428,013 | 2/1969 | Prew | 114/74 A |

FOREIGN PATENT DOCUMENTS

| | | | |
|---|---|---|---|
| 1239027 | 6/1986 | U.S.S.R. | 114/71 |

*Primary Examiner*—Joseph F. Peters, Jr.
*Assistant Examiner*—Edwin L. Swinehart

[57] ABSTRACT

A method and device for controlling strain and deflection in a superstructure, resulting from movement/displacement of the main structure on maritime and aerospace vessels, and other structures which have significant strains and/or deflections induced by support displacements. This method involves the use of elastic devices inserted in the said superstructure and fine tuned with respect to stiffness, to an extent where the load distribution throughout the said superstructure can be controlled. The device is constructed by the use of material formed in a geometric shape which will allow yielding, to a desired amount of strain and/or deflections, in the elastic device, superstructure and main structure.

5 Claims, 3 Drawing Sheets

METHOD AND DEVICE FOR CONTROLLING STRAIN AND/OR DEFLECTION IN SUPERSTRUCTURES

BACKGROUND OF THE INVENTION

1. Field of the Invention:

The present invention relates a method and device for controlling strain, deflection, and therefore stress, in a superstructure on maritime and aerospace vessels. Specifically, the present invention relates to naval vessels with superstructures that are prone to cracking due to design, material and/or installation flaws.

2. Description of the Prior Art:

With the advent of aluminum superstructures on board naval vessels, the use of expansion joints in the superstructure became common. These expansion joints were designed to isolate different sections of the superstructure and therefore prevent load transfer or buildup of strain in these sections. In general only the primary hull structure was used to resist the bending stresses caused by hogging and sagging conditions. Because of the material and the complexity of the expansion joints, maintenance problems became major concerns. Also, because there was no load transfer between isolated sections of the superstructure, there was no way to regulate the relative displacements between the sections. This condition created problems in operation of alignment critical equipment such as fire control directors, guns and launchers. Because of these problems, recent designs in naval shipbuilding have sought to eliminate the use of expansion joints. However, because of the complex stress distribution, and inherent flaws in the welding of aluminum, design level stresses have caused major cracking failures in the FFG-7, DD-963, DDG-2 and CG-47 Class ships. Therefore more recently, designs in naval shipbuilding have changed the superstructure material to steel in lieu of aluminum. While this solution reduces the cracking problem, a weight and stability problem becomes more prevalent. Steel superstructures weigh approximately 2 to 3 times more than those constructed of aluminum. In general, steel superstructures do not solve the cracking problem by controlling stress distribution, but rather by overdesign in terms of selection of material.

SUMMARY OF THE INVENTION

The object of this invention is to provide a method of controlling strains and deflections within a structure undergoing environmental and/or operational loads, as well as within an elastic device that will allow for such control. It is of interest to most structurally oriented designers, architects and engineers, the concept of controlling strain within structures. The ability to shift a desired amount of strain within a structure, from one substructure to another will allow for a very efficient design of the addressed structure and the avoidance of the initiation and propagation of flaws into nuisance cracks or catastrophic failures. Additionally, relative deflections between fire control directors, guns, launchers and other alignment critical systems can be regulated within desired limits by location and design of the elastic device. A specific form of the invention can be used in the design or refit of a large surface ship constructed of a primary structure (hull) and secondary structure (superstructure), duly outlined in the Description of Prior Art. Should the cognizant representative of the ship find that the design loading caused unacceptable high longitudinal strains in the superstructure during the hogging and sagging cycle of design loads and moderate longitudinal strains in the hull, they now have the option to insert an elastic device so analyzed and arranged to allow a desired amount of longitudinal strain to be relieved from the superstructure and transferred to the moderately strained hull. Similarly, the relative deflection of alignment critical systems, as mentioned above, can be controlled by such devices and still relieve the superstructure of a desired amount of strain. The clarity of the above summary and other objectives, features and advantages of the invention will be enhanced from the Descriptions of the Preferred Embodiment and associated drawings.

DESCRIPTION OF THE PREFERRED EMBODIMENT

The accompanying FIGS. 1 through 5 show the preferred embodiment of the invention which is a device for controlling strain and deflection levels, caused by hull deformation, in a superstructure of a ship. This elastic device, denoted by the number 1 is inserted in the superstructure 3, in the transverse direction and thereby segmenting the superstructure longitudinally, and is enclosed by an outer protective cover 2.

Figure 1:
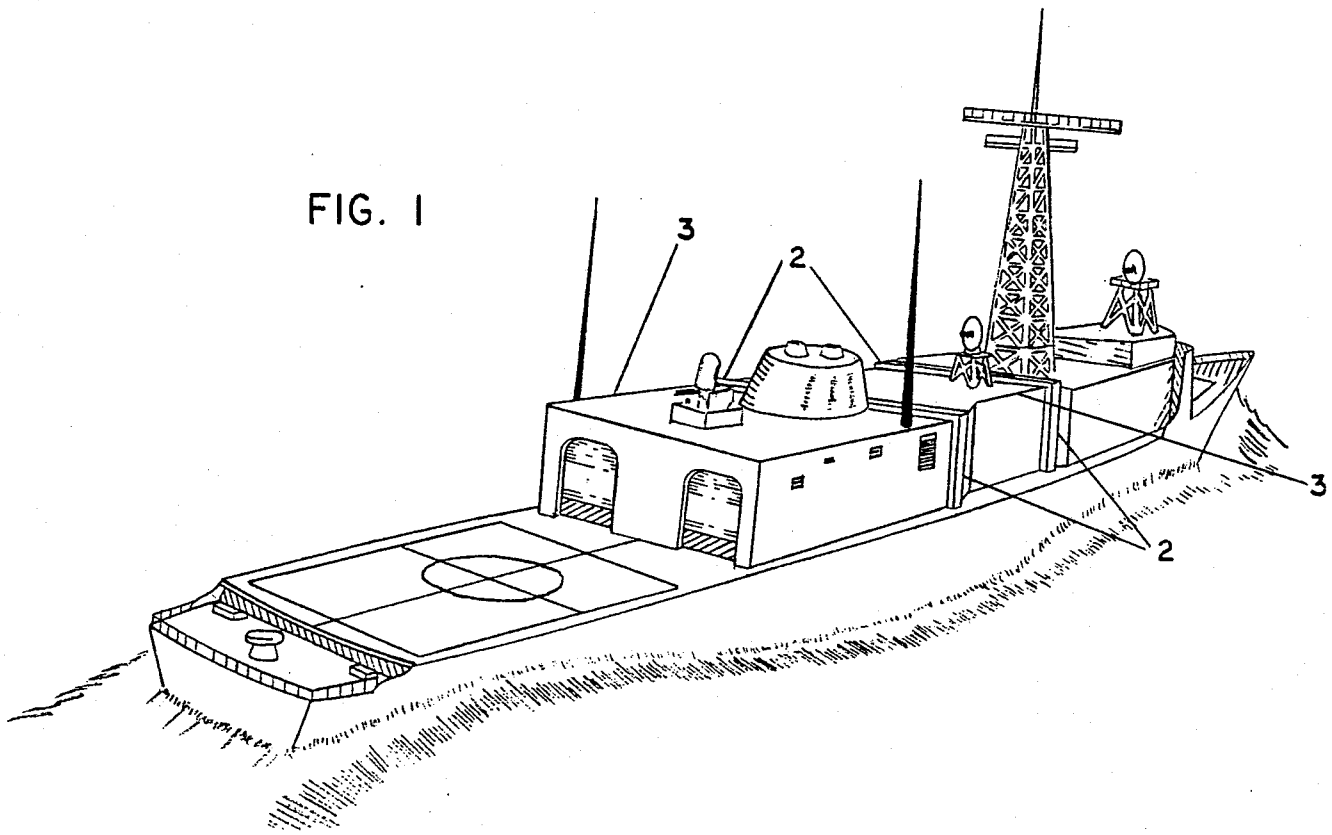
FIG. 1 is a perspective view of a naval vessel showing locations of outer covers enclosing subject elastic devices, arranged in the transverse direction of the ship.
Figure 3:
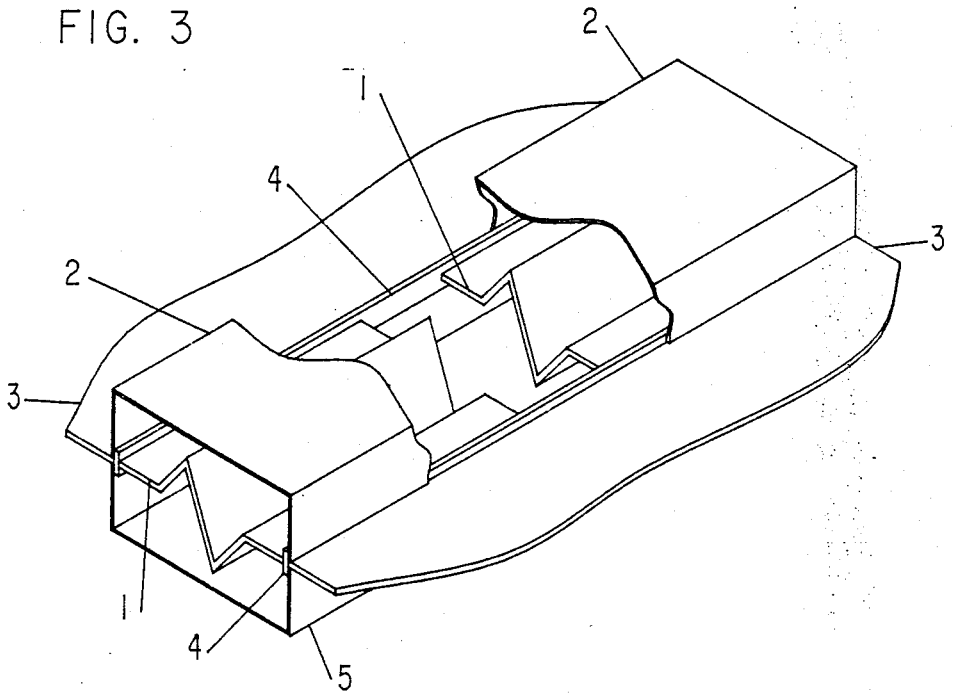
FIG. 3 is an isometric view of a segmented Z-type elastic device with both outer and inner protective covers constructed of material similar to that of the superstructure.
Figure 2:
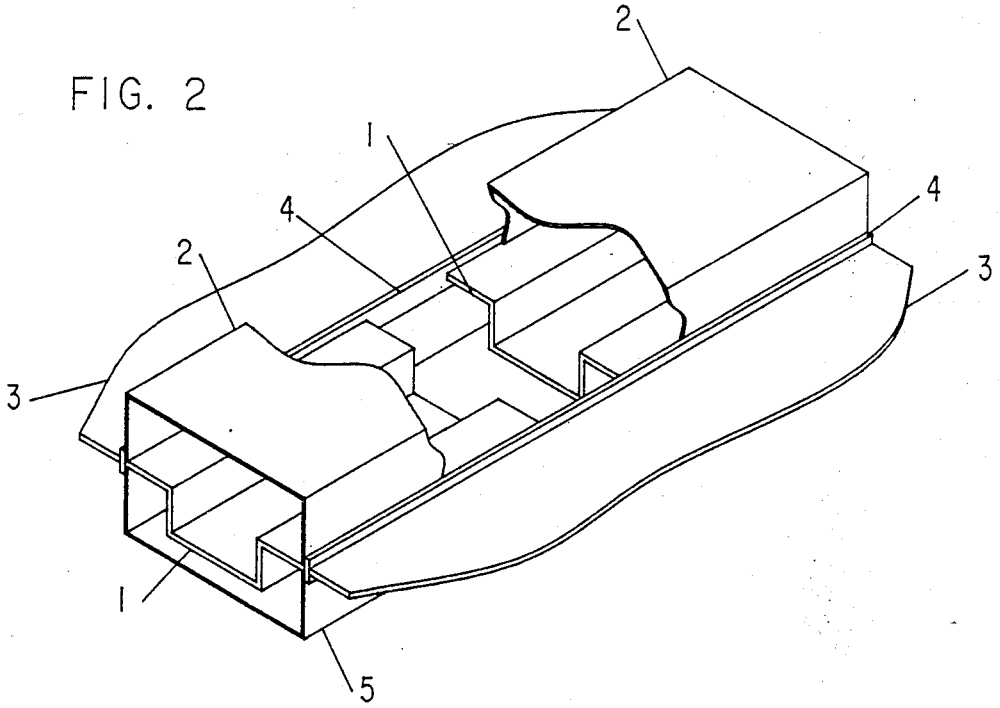
FIG. 2 is an isometric view of a segmented U-type elastic device with both outer and inner protective covers constructed of material similar to that of the elastic device.
Figure 4:
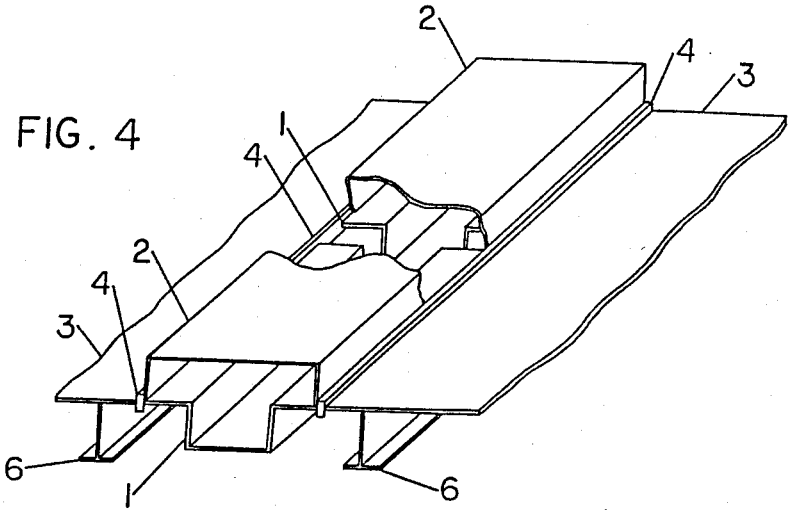
FIG. 4 is an isometric view of a segmented U-type elastic device with only an outer protective cover constructed of material similar to that of the elastic device.

In this embodiment the elastic device 1 is shown as a geometric shape. FIGS. 2 and 4 show a U-type elastic device 1. FIG. 3 shows a Z-type elastic device 1. The geometric shapes shown in FIGS. 2 through 4 are much stiffer than the outer and inner protective covers (2 and 5 respectively) and therefore serve as the main members to transfer load between, and control strain in, sections of the superstructure 3.

The stiffness of the elastic device 1 which joins the various super-structure sections together, can be designed with varying stiffness along its length, which will account for local superstructure discontinuities and/or changes in overall stiffness and therefore allow a calculated amount of strain/load.

Figure 5:
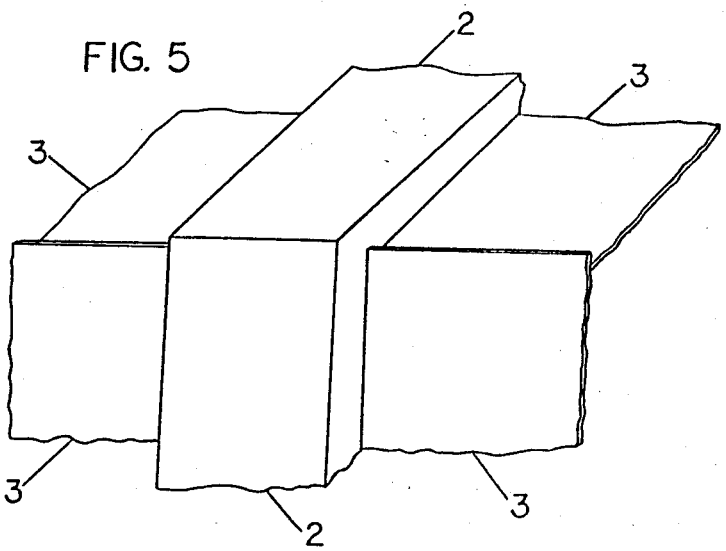
FIG. 5 is a isometric view of an intersection of an outer protective cover, illustrating the water tight boundary.

In this embodiment the elastic device 1 is attached to the superstructure by welding, utilizing a bimetallic strip 4. In FIGS. 2 and 4 the bimetallic strip 4 appears on the outside of the outer protective cover 2 if the material of the outer protective 2 cover is different than that of the superstructure 3. In FIG. 3 the bimetallic strip 4 appears on the inside of the outer protective cover 2 because the superstructure 3 and the outer protective cover 2 are of the same material. In FIGS. 2 through 4 the outer protective cover 2 forms a water tight boundary for the segmented elastic device 1. In FIG. 5 the outer protective cover 2 is used to provide a continuous water tight boundary around intersections of the superstructure 3.

In this embodiment the outer protective cover 2 and the inner protective cover 5 in FIGS. 2 and 3 act as the transverse strength frame to support the superstructure 3. In FIG. 4 existing or new transverse members 6 are utilized to form the transverse strength frame.

We claim:

1. A stiffness tuned structural load carrying elastic device for use in and between spaced sections of a superstructure of a ship said device, consisting of joining sections, each formed with an offset discontinuity which are attached between sections of a superstructure of a ship which will allow a predetermined amount of strain and deflection and load between said sections of aid superstructure and will limit the initiation of new cracks and the propagation of existing cracks and flaws in the said superstructure.

2. The device as set forth in claim 1 which will allow a predetermined amount of change in the strain and deflection in a hull structure supporting said superstructure.

3. The device as set forth in claim 1 with varing stiffness along the said device's length to account for local superstructure discontinuites and changes in said superstructure stiffness.

4. The device as set fourth in one of claims 1 or 3 which includes easily deforming weather-tight covers which encloses said device.

5. The device as set forth in one of claims 2 or 3 with weathertight covers which enclose said device and provide structural support for the ends of sections of the said superstructure and easily deform in the direction of said predetermined load.

* * * * *